US006152575A

United States Patent [19]

Montanino

[11] Patent Number: 6,152,575

[45] Date of Patent: Nov. 28, 2000

[54] LIGHTED SERVING TRAY

[76] Inventor: Joseph F. Montanino, 849 N. 2770 West, Provo, Utah 84601

[21] Appl. No.: 09/336,260

[22] Filed: Jun. 18, 1999

[51] Int. Cl.[7] ..... F21V 23/04; F21L 4/08

[52] U.S. Cl. ..... 362/251; 362/183; 362/154; 362/234; 362/800; 362/802

[58] Field of Search ..... 362/183, 154, 362/156, 234, 251, 253, 276, 394, 800, 802

[56] References Cited

U.S. PATENT DOCUMENTS

| | | | |
|---|---|---|---|
| 3,705,982 | 12/1972 | Smolinski | 362/154 |
| 4,254,452 | 3/1981 | Switala | 362/154 |
| 4,446,508 | 5/1984 | Kinzie | 362/253 |
| 4,803,604 | 2/1989 | Nichols et al. | 362/154 |
| 5,355,289 | 10/1994 | Krenn | 362/253 |
| 5,430,628 | 7/1995 | Saunders | 362/253 |

*Primary Examiner*—Alan Cariaso

*Attorney, Agent, or Firm*—Angus C. Fox, III

[57] ABSTRACT

A lighted serving tray includes a tray body having platter portion and a chamber portion attached to the underside of the platter portion. The chamber portion houses a plurality of lights which are installed in a perimetric wall thereof, a battery pack coupled to a recharging jack installed within the perimetric wall, and coupled to each of the lights via circuit elements, which includes at least one normally-on, on-off switch installed in a lower panel of the chamber portion, and which may include a flashing circuit. For a preferred embodiment of the invention, each of the lights is a light-emitting diode (LED) so as to minimize current drain. Also for the preferred embodiment of the invention, each of the on-off switches is installed within its own recess in the lower panel in such a manner that a movable activating element of the switch extends below a lower major surface of the lower panel. Thus, when the serving tray is placed on a substantially planar surface, the activating element is moved to an "off" position, thereby cutting power to the lights and to the flashing circuit.

20 Claims, 4 Drawing Sheets

LIGHTED SERVING TRAY

FIELD OF THE INVENTION

This invention relates to serving equipment used in restaurants, bars and night clubs and, more particularly, to serving trays used primarily to serve beverages, hors d'oeuvres, or the like.

BACKGROUND OF THE INVENTION

Music, decor and lighting are used extensively in night dubs and bars to create a dazzling, surreal atmosphere for a generation raised on video games, MTV, deafening music, fast action sports, and fantasy motion pictures of a high-tech future.

Lighted serving trays attractively complement the high-tech atmosphere prevalent at many night clubs and bars. Not only do the lights on the tray add to the atmosphere, they also make the tray visible within areas of low lighting intensity when being carried by a waiter or waitress, thereby reducing inadvertent collisions with patrons. At least several lighted serving tray designs are the subject of issued U.S. patents. The first, U.S. Pat. No. 5,355,289 to Ronald J. Krenn, discloses a lighted serving tray which includes a tray portion having flat bottom surface, a perimeter rim, and a hollow transparent tube attached to the tray adjacent to the perimeter rim. A plurality of lights, which may be LEDs, are attached in the transparent tube in a spaced relationship to each other and a battery is connected through an electrical conductor to each of the lights through a switch. A flashing circuit can be connected in the circuit. The second, U.S. Pat. No. 5,430,628 to Timothy R. Saunders, discloses a lighted serving tray having a discus shaped platter with an interior hollow in which a tubular light array is positioned. The tray includes a serving surface upon which drink glasses may be placed. A central transparent portion of the serving surface transmits light from the light array to illuminate a sponsor logo. The base portion of the tray may be translucent and colored light emitting. A case affixed to the serving surface serves both as a change compartment for use by the waiters/waitresses and as a housing for batteries which power the light array.

Although both of these inventions have been known to the public for at least five years, they are very scarce in the bar and nightclub environment. The reluctance to purchase large quantities of these devices may be due, in part, to the relatively limited charge life of the batteries. The problem of limited charge life is exacerbated by the need to manually cut off power to the light arrays when the trays are not in use. During business hours in a bar or nightclub, a serving tray spends about half its time parked on the bar counter awaiting the loading of drinks prepared by the bar tender. During these periods, there is little reason for the lights of the tray to be draining the batteries. If the lights were automatically shut off when the tray is not being carried, battery life could be doubled. Another potential problem with these prior art devices is the location of the batteries on top of the serving tray. If a drink is spilled, electronic function may be easily impaired. Another problem is the location of the power pack. By having the battery pack on top of the serving surface, wiring must pass through the serving surface to the light array below. At least in the case of U.S. Pat. No. 5,430,628, a sealant must be used to prevent leakage into the lower chamber. Reliability of the electronics is dependent on the effectiveness of the sealant used and the care with which it is applied to the wire pass-through aperture in the serving surface. An additional disadvantage is the need to change batteries frequently. Although battery life may be extended by providing larger capacity batteries, the additional weight required by a larger battery pack increases the load that a waitress must carry while serving patrons.

What is needed is a lighted serving tray which eliminates the disadvantages of no automatic light shut-off feature, battery pack location above the serving surface, and a need to change batteries every day or two of use. These improvements over the prior art devices must be delivered by a new serving tray that is durable and inexpensive to manufacture and maintain.

SUMMARY OF THE INVENTION

A lighted serving tray includes a tray body having a platter portion and a chamber portion attached to the underside of the platter portion. The serving tray includes a plurality of lights which are installed in a perimetric wall of the chamber portion; a battery pack coupled preferably in parallel with each of the lights; an optional recharging circuit located within the chamber portion, which may be connected to an outside power source via a jack installed preferably within the perimetric wall; and at least one normally-on, on-off switch installed in a lower panel of the chamber portion which, when activated, cuts off power from the battery pack to all of the lights. The tray may optionally include a flashing circuit which causes each of the lights to blink when power is being drawn from the battery pack. For a preferred embodiment of the invention, each of the lights is a light-emitting diode (LED) so as to minimize current drain. Also for the preferred embodiment of the invention, at least two, series-connected, on-off switches are utilized, with each of the switches being installed within a recess in the lower panel in such a manner that a movable activating element of the switch extends below a lower major surface of the lower panel. Thus, when the serving tray is placed on a substantially planar surface, the activating element is moved to an "off" position, thereby cutting power to the lights and to the flashing circuit. For a preferred embodiment of the invention, the tray body is fabricated from a polymer material such as ABS, polystyrene, or polycarbonate plastic. However, the invention should not be construed to exclude tray bodies fabricated from other materials, such as stainless steel, plated steel, brass, or fiber-reinforced plastic. The tray body may be injection molded or vacuum formed. To enhance rechargeability of the battery pack, no-memory batteries are used. Lithium ion batteries are only one example of such batteries.

DETAILED DESCRIPTION OF THE INVENTION

Various embodiments of the new lighted serving tray will now be described with reference to the accompanying drawings. FIGS. 1 through 4 depict a circular serving tray, while FIGS. 5 through 8 depict a substantially rectangular serving tray. Other than the shape of the two trays, which is dictated by the shape of platter portion thereof, the two embodiments are virtually identical with respect to function and componentry.

Figure 1:
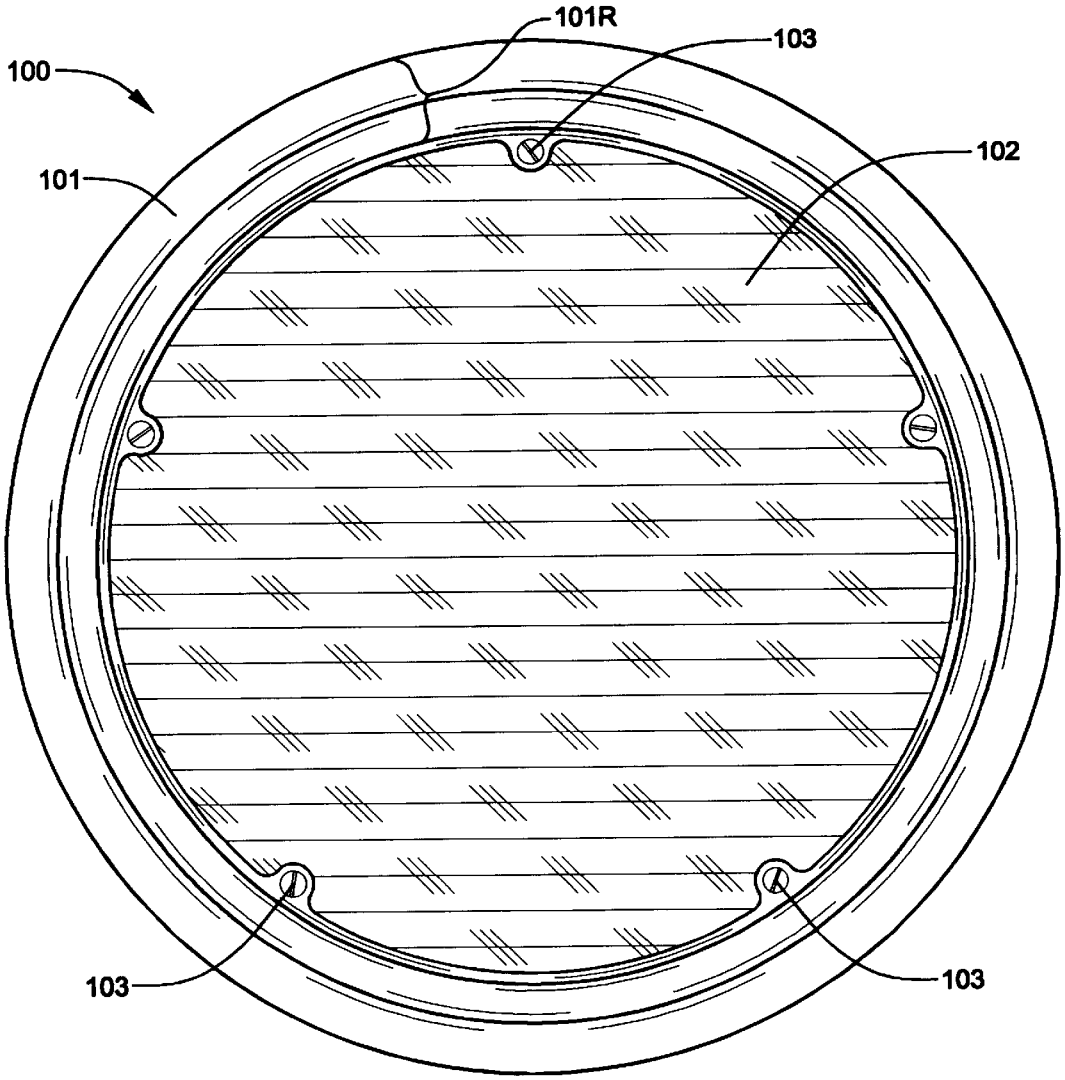
FIG. 1 is a side elevational see-through view of a circular embodiment the new lighted serving tray.
Figure 2:
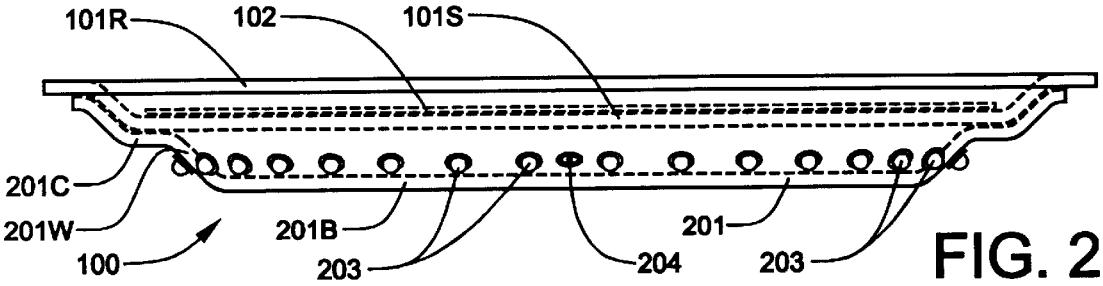
FIG. 2 is a top plan view of the new lighted serving tray of FIG. 1.

Referring now to FIG. 1, the circular embodiment of the new lighted serving tray 100 includes a tray body having two components: a platter portion 101 and a chamber portion 201 (see FIG. 2). The platter portion 101 is shaped like a conventional unlighted circular platter or serving tray. The platter portion has an upper serving surface portion 101S (see FIG. 2) bounded by a raised rim portion 101R. The serving surface portion 101S is covered with a resilient, slip-resistant layer 102. For the currently preferred embodiment of the invention, the slip-resistant layer is made of cork. Five screw-type fasteners 103 are visible in this view and their function will be described with reference to FIG. 2. and FIG. 4.

Referring now to FIG. 2, the chamber portion 201 of the tray body is attached to the underside of the platter portion 101 with the five screw-type fasteners 103. Both the platter portion 101 and the chamber portion 201 may be fabricated from a variety of materials. For a preferred embodiment of the invention, the tray body is fabricated from a polymer material such as ABS, polystyrene, or polycarbonate plastic. However, the invention should not be construed to exclude tray bodies fabricated from other materials, such as stainless steel, plated steel, brass, or fiber-reinforced plastic. The tray body may be stamped, injection molded or vacuum formed. All components related to the lighting function are contained within the chamber portion 201. The chamber portion 201 has an attachment collar portion 201C, a perimetric wall portion 201W continuous with the collar portion 201C, and a bottom panel portion 201B continuous with the wall portion 201W. A plurality of light emitting diodes (LEDs) 203 are installed within the perimetric wall portion 201W, as is a low-voltage jack 204. Also installed within the chamber portion 201 is a battery pack (not shown in this view), optional flashing circuitry (not shown in this view) which causes the LEDs 203 to blink, charging circuitry (not shown in this view) which permits the battery pack to be recharged without removing the battery pack from the serving tray 100, and wiring which interconnects the jack 204 to the recharging circuitry, the recharging circuitry to the battery pack, and the battery pack to the LEDs 203. By connecting the jack 204 to an external power source (not shown), the recharging circuitry may be powered in order to recharge the battery pack. The external power source is preferably a direct current source in order to eliminate the need for rectifying circuitry on board the serving tray 100.

Figure 3:
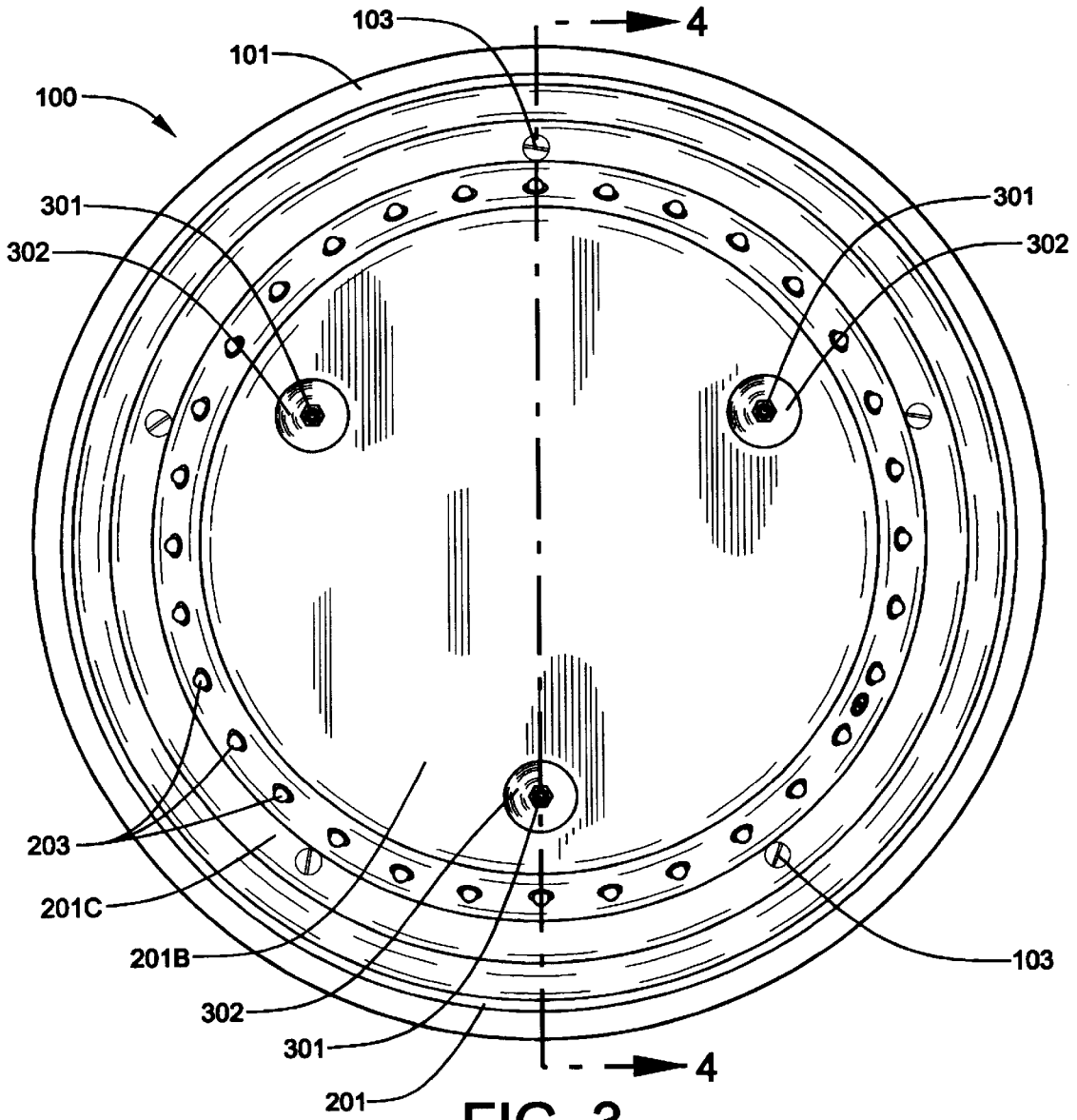
FIG. 3 is a bottom plan view of the new lighted serving tray of FIG. 1.

Referring now to FIG. 3, a plurality of screw-type fasteners 103, which are employed to secure the platter portion 101 of the tray 100 to the chamber portion 201, are also visible in this bottom view of the tray. It should be evident that the platter portion 101 and the chamber portion 201 can be permanently fused together if the battery pack is rechargeable over a long period of time without significant degradation in storage capacity and if quality circuitry and switches are employed for the tray's manufacture. All thirty-two LEDs 203 installed within the perimetric wall 201W are visible in this view. Although the number of light sources present on the tray is not deemed to be a defining characteristic of the invention, the greater the number of light sources, the greater the power requirements. Three series-connected, normally-on, on-off switches 301, each installed within its own recess 302 within the lower panel portion 201B provide automatic shut-off of power to the LEDs 203 when the tray 100 is placed on a substantially planar surface, such as a counter-top or table. An activation button 301A (see FIG. 4) in each switch 301 extends below the lower major surface of the bottom panel portion 201B so that if any one of the switches 301 is activated, the power to all LED's 203 is cut off. This feature extends the useful life of the battery pack by cutting off power when the tray is being filled with drinks or when it is being stored.

Figure 4:
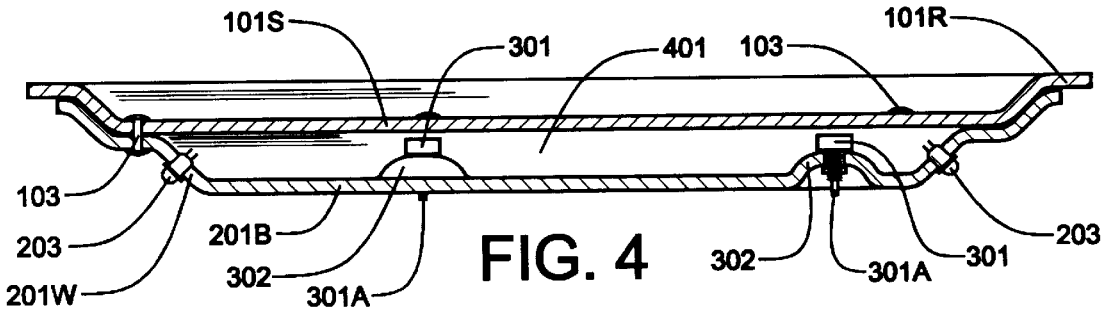
FIG. 4 is a cross-sectional view of the new lighted serving tray of FIG. 1, taken through section line 4—4 of FIG. 3.

The cross-sectional view of FIG. 4 more clearly shows the switches 103 and the recesses 302 in which the switches 301 are mounted, and the activating buttons 301A of two switches 301. In FIG. 4, the cork layer 102 has been removed from the upper surface of the serving surface portion 101S. Also in this view, it will be seen that one screw-type fastener 103 passes through the collar portion 201C of the body chamber portion 201 and through the periphery of the serving surface portion 101S. All five fasteners 103 function similarly to secure the platter portion 101 to the chamber portion 201. The chamber 401, formed by the joining of the platter portion 101 and the chamber portion 201, contains the battery pack, the charging circuitry, the rear portion of each switch 301, and the rear portion of each LED 203.

Figure 5:
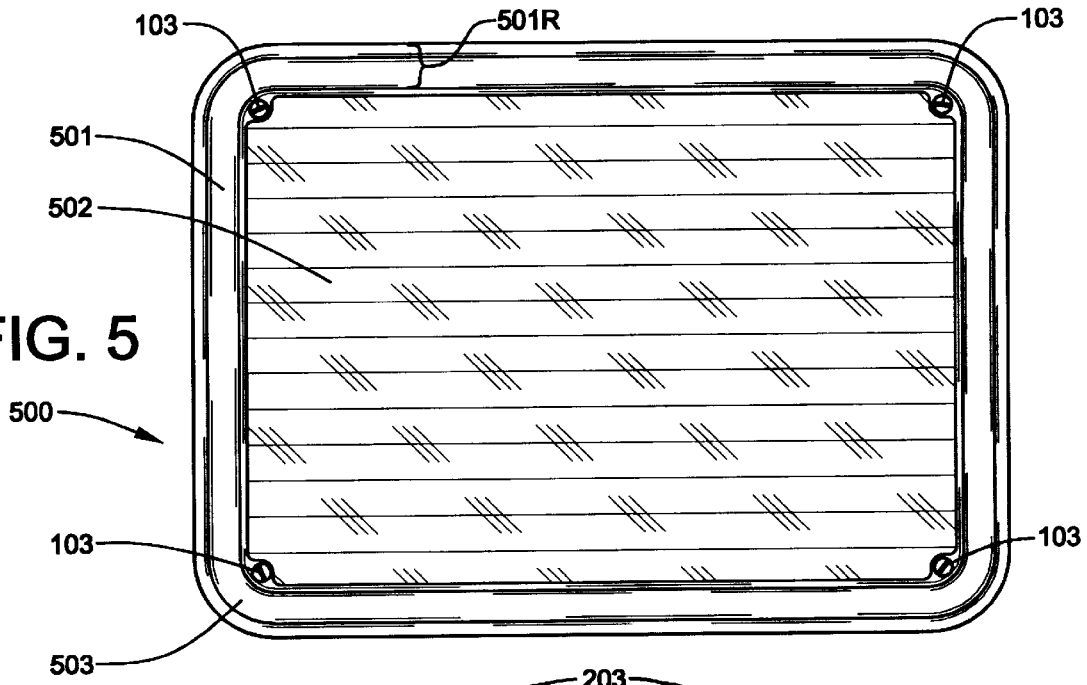
FIG. 5 is a top plan view of a substantially rectangular embodiment of the new lighted serving tray.

Referring now to FIG. 5, the rectangular embodiment 500 of the lighted serving tray has a rectangular platter portion 501 with a raised perimetric rim portion 501R, a serving surface portion 501S (see FIG. 7), and radiused corners 503. A resilient cork layer 502 covers the serving surface portion 501S. All four screw-type fasteners 103 visible in this view are employed to secure the platter portion 501 to the chamber portion 601.

Figure 6:
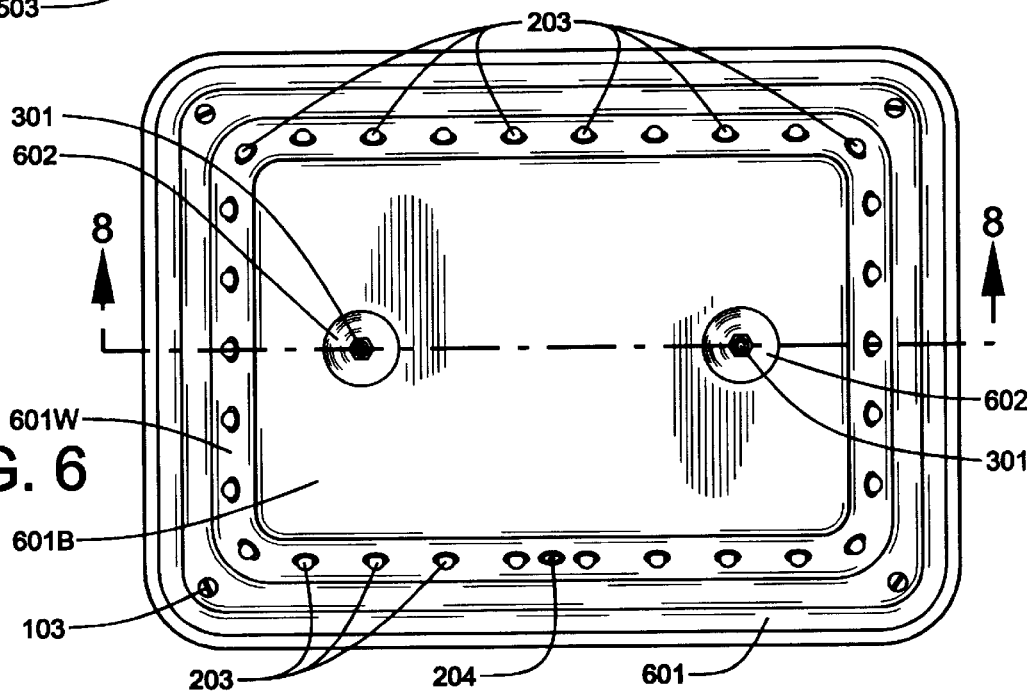
FIG. 6 is a bottom plan view of the new lighted serving tray of FIG. 5.

In FIG. 6, the rectangular chamber portion 601 is visible. The opposite ends of the four screw-type fasteners 201 are also visible in this view. Like the circular embodiment of the invention, the rectangular chamber portion 501 has an attachment collar portion 501C, a perimetric wall portion 501W, and a bottom panel portion 501B, all of which are continuous one with another. Thirty LEDs 203 are installed in the perimetric wall portion 501W, as is a low-voltage jack 204 for recharging the battery pack which is also installed within the chamber portion 501. This embodiment of the invention utilizes a pair of series-coupled switches 301 which are mounted within recesses 602. They function in the same manner as the switches of the first embodiment.

Figure 7:
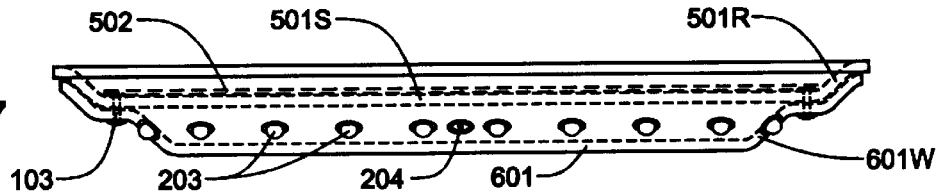
FIG. 7 is a side elevational see-through view of the new lighted serving tray of FIG. 5.
Figure 8:
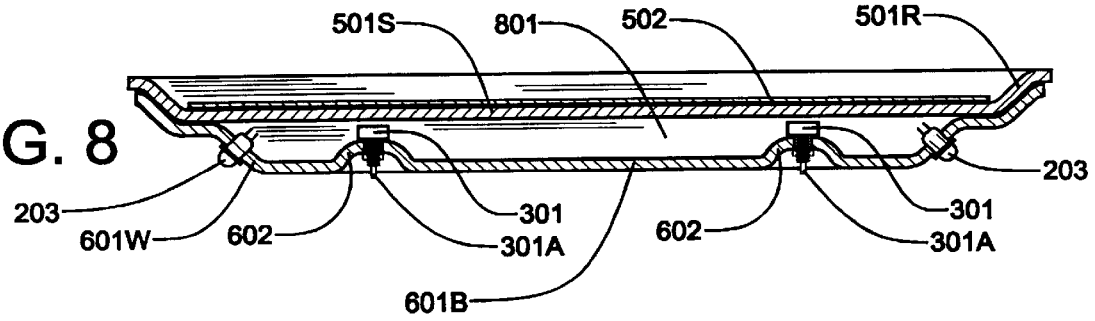
FIG. 8 is a cross-sectional view of the new lighted serving tray of FIG. 5, taken through section line 8—8 of FIG. 6.

Referring now to FIG. 7, the screw-type fasteners 103 are visible and show the manner by which the platter and chamber portions 501 and 601, respectively, are fastened together. The jack 204 for recharging the battery is also visible. In FIG. 8, the recesses 602 in which each of the switches 301 are installed are also clearly visible. The recesses are formed as part of the bottom panel portion 601B during the forming, molding or stamping process. The chamber 801, formed by the joining of the platter portion 501 and the chamber portion 601, contains the battery pack, the charging circuitry, the rear portion of each switch 301, and the rear portion of each LED 203.

Referring now to FIG. 9, a block diagram of the circuitry within the chamber 401 or 801 includes a low-voltage recharging jack 204, a charger circuit 901, a battery pack 902, a flasher circuit 903 and multiple LEDs 203 connected in parallel with the output from the battery pack 902 and flasher circuit 903. The power disconnect switches 904 are connected in series between the battery pack 902 and a bypass switch 905 so that activation of either disconnect switch 904 will cut-off power to the LEDs. It may be desirable to switch between flashing LEDs and LEDs that are on continuously. Therefore, the bypass switch 905 selectively decouples the flasher circuit 903 so that the LEDs are continuously powered by the battery pack 902. The bypass switch 903 may be installed anywhere in the chamber portion 101B or 601, but like the jack 108, is most conveniently installed within the perimetric wall 201W or 601W.

Although only several embodiments of the invention have been heretofore described, it will be obvious to those having ordinary skill in the art that changes and modifications may be made thereto without departing from the scope and the spirit of the invention as hereinafter claimed.

What is claimed is:

1. A lighted serving tray comprising:

a tray body having a platter portion with a raised perimetric rim, a lower surface, and an upper serving surface on which food and drinks may be carried; and a chamber portion having a collar portion, a perimetric wall portion, and a bottom panel portion having a lower major surface, said collar portion being attached to the lower surface of said platter portion, thereby forming an enclosed chamber bounded by the platter portion, the perimetric wall portion and the bottom panel portion;

a plurality of light emitting diodes (LEDs) installed within apertures formed within the perimetric wall portion, such that the light-emitting end of each LED is outside the chamber;

a battery pack coupled to each LED;

a flasher circuit interposed between the battery pack and each of the LEDs;

at least one disconnect switch interposed between the battery pack and said flasher circuit, said disconnect switch having an activating element, said switch being installed within said bottom panel portion so that said activating element extends below said major surface so that when the tray is placed upon a substantially planar surface, said activating element is displaced, thereby cutting off power to said flasher circuit and said LEDs.

2. The lighted serving tray of claim 1, which further comprises a bypass switch which may be selectively activated to either decouple the flasher circuit from the LEDs and thereby provide continuous power to the LEDs, or couple the flasher circuit to the LEDs and thereby provide intermittent power to the LEDs.

3. The lighted serving tray of claim 1, which further comprises a jack coupled to said recharging circuit, which permits connection of said recharging circuit to an external power source.

4. The lighted serving tray of claim 1, wherein said platter portion is circular.

5. The lighted serving tray of claim 1, wherein said platter portion is rectangular with rounded corners.

6. The lighted serving tray of claim 1, which further comprises a plurality of screw-type fasteners, which are employed to secure said chamber portion to said platter portion.

7. The lighted serving tray of claim 1, wherein each of said disconnect switches is installed within a recess in said bottom panel portion.

8. The lighted serving tray of claim 1, which further comprises a resilient, slip-resistant layer overlying said serving surface portion.

9. A lighted serving tray comprising:

a tray body having a platter portion, a lower surface and an upper surface on which drinks and food may be carried, a perimetric wall portion attached to said lower surface, and a bottom panel portion continuous with said wall portion, said bottom panel portion having a lower major surface having recesses therein, said platter portion, said perimetric wall portion and said bottom panel portion forming a chamber;

a plurality of light emitting diodes (LEDs) installed within apertures formed within the perimetric wall portion, such that the light-emitting end of each LED is outside the chamber;

a battery pack coupled to each LED, said battery pack located within said chamber;

a flasher circuit interposed between the battery pack and each of the LEDs, said flasher circuit located within said chamber;

one disconnect switch installed within each recess, said disconnect switches coupled in series between said battery pack and said flasher circuit, each of said disconnect switches activatable by placing the serving tray on a substantially flat surface.

10. The lighted serving tray of claim 9, which further comprises a bypass switch which may be selectively activated to either decouple the flasher circuit from the LEDs and thereby provide continuous power to the LEDs, or couple the flasher circuit to the LEDs and thereby provide intermittent power to the LEDs.

11. The lighted serving tray of claim 9, which further comprises a jack coupled to said recharging circuit, which permits connection of said recharging circuit to an external power source.

12. The lighted serving tray of claim 9, wherein said platter portion is circular.

13. The lighted serving tray of claim 9, wherein said platter portion is rectangular with rounded corners.

14. The lighted serving tray of claim 9, which further comprises a resilient, slip-resistant layer overlying said serving surface portion.

15. The lighted serving tray of claim 14, wherein said resilient slip-resistant layer is made from cork.

16. The lighted serving tray of claim 9, wherein said platter portion has a raised perimetric rim.

17. A lighted serving tray comprising:

a platter having an upper serving surface and a lower surface;

an enclosure attached to the lower surface of said platter, said enclosure having a perimetric wall and a bottom panel having a lower major surface;

a plurality of LEDs installed within said perimetric wall;

a battery pack located within said enclosure coupled to each LED;

at least one disconnect switch installed within said bottom panel, said disconnect switch having an activating element extending below said lower major surface which is displaced to activate said disconnect switch when said tray is placed on a substantially planar horizontal surface, thereby decoupling said battery from each of said LEDs.

18. The lighted serving tray of claim 17, which further comprises a flashing circuit located within said enclosure, said flashing circuit being interposed between said battery and at least some of said LEDs in order to provide intermittent power to said some LEDs.

19. The lighted serving tray of claim 17, wherein each disconnect switch is installed within a recess within said bottom panel.

20. The lighted serving tray of claim 17, which further comprises a charging circuit installed within said recess and a jack installed within said perimetric wall, said charging circuit coupled to both said jack and said battery pack, said battery pack being rechargeable by connecting said jack to an external power source.

* * * * *